US005558286A

United States Patent [19]

Sugioka et al.

[11] Patent Number: 5,558,286

[45] Date of Patent: Sep. 24, 1996

[54] YARN WINDER

[75] Inventors: Takami Sugioka; Toshihiro Yudate; Yuji Seike, all of Matsuyama, Japan

[73] Assignee: Teijin Seiki Co., Ltd., Osaku-Fu, Japan

[21] Appl. No.: 180,417

[22] Filed: Jan. 12, 1994

[30] Foreign Application Priority Data

Jan. 14, 1993 [JP] Japan ..... 5-022119

[51] Int. Cl.[6] ..... B65H 67/044; B65H 54/28

[52] U.S. Cl. ..... 242/18 A; 242/43 R

[58] Field of Search ..... 242/18 A, 25 A, 242/35.5 T, 43 R

[56] References Cited

U.S. PATENT DOCUMENTS

| | | | |
|---|---|---|---|
| 4,166,587 | 9/1979 | Miller | 242/18 A |
| 4,304,364 | 12/1981 | Busch | 242/18 DD |
| 4,613,089 | 9/1986 | Munnekehoff | 242/43 R |
| 4,989,798 | 2/1991 | Nickell | 242/18 R |
| 4,993,650 | 2/1991 | Nickell | 242/18 R |
| 5,029,762 | 7/1991 | Behrens et al. | 242/18 A |
| 5,100,072 | 3/1992 | Behrens et al. | 242/18 A |
| 5,112,000 | 5/1992 | Derichs et al. | 242/18 DD |
| 5,246,177 | 9/1993 | Sugioka | 242/18 A |

FOREIGN PATENT DOCUMENTS

| | | | |
|---|---|---|---|
| 0374536 | 6/1990 | European Pat. Off. . | |
| 0460546 | 12/1991 | European Pat. Off. . | |
| 567091 | 10/1993 | European Pat. Off. | 242/18 A |
| 4029858 | 5/1991 | Germany . | |
| 2276771 | 11/1990 | Japan . | |

*Primary Examiner*—Michael R. Mansen
*Attorney, Agent, or Firm*—Rothwell, Figg, Ernst & Kurz, P.C.

[57] ABSTRACT

A yarn winder, used for winding various kinds of yarns by automatically setting the moving speed of a bobbin holder so that it is suitable for the increasing size of the yarn package wound onto the winding bobbin holder. In the winder, while a contact roller (7) is pressed onto a bobbin (9) inserted onto a bobbin holder (8) or a yarn layer wound on the bobbin (9), a yarn (Y) is traversed by a traverse apparatus (6), and thus, the yarn is wound on the bobbin. The movement of the contact roller due to increase of the wound yarn is detected by a sensor (16), and the slider is moved based on signals detected by the sensor so as to move the bobbin holder in such a direction that it moves away from the contact roller. The slider is actuated by signals from the sensor detecting the amount of the movement of the contact roller, and the speed of the winder can be varied stepwise or continuously.

4 Claims, 6 Drawing Sheets

YARN WINDER

TECHNICAL FIELD OF THE INVENTION

The present invention relates to a yarn winder for winding a continuously supplied yarn on a bobbin inserted onto a bobbin holder.

PRIOR ART

In conventional yarn winders, for example, in a yarn winder disclosed in Japanese Patent Application Laid-open No. Hei 4-276771, the increase of wound yarn is detected as the amount of movement of a contact roller, and the speed of a winding bobbin holder moving away from the contact roller is always set constant or is set at a constant value for a time interval which value is programmed in accordance with the wound diameter of the wound package.

According to such conventional winders, although the moving speed of the bobbin holder is always maintained at a predetermined constant value or is programmed to successively vary in accordance with the wound diameter of the wound package, the moving speed of the bobbin holder has to be previously set at a maximum speed which can cope with all the possible situations or it has to be temporarily set at an appropriate value on all such occasions, since the increasing speed of a package during winding up may be changed depending on the winding conditions, such as the thickness of the yarn, the traverse stroke of the package, or the winding speed.

In the meantime, in order to suitably wind up a yarn package without causing a yarn drop at the package ends, it is preferred that the bobbin holder be moved in accordance with the increase of the yarn package and as slowly as possible.

If the moving speed of the bobbin holder is set at a maximum speed which can cope with all the possible situations as described above, the bobbin holder may be moved at an excessively high speed even when a thin yarn is wound. Such a thin yarn is easily subjected to a yarn drop at the package ends, and therefore it does not require the bobbin holder to be moved quickly. Further, the moving speed of the bobbin holder is temporarily set at an appropriate value on all occasions taking the winding yarn into consideration, thus the setting operations may be troublesome.

OBJECT OF THE INVENTION

It is an object of the present invention to provide a yarn winder which is provided with good operability and which can be used for winding various kinds of yarns by automatically setting the moving speed of a bobbin holder so that it is suitable for increasing a yarn package wound onto the winding bobbin holder.

SUMMARY OF THE INVENTION

According to the first aspect of the present invention, the above-described object is achieved by a yarn winder comprising a bobbin holder for inserting a bobbin thereonto, a contact roller pressed onto the bobbin inserted onto the bobbin holder or a yarn layer wound on the bobbin, a traverse apparatus for traversing a yarn along the bobbin, a sensor for detecting a movement of the contact roller due to increase of the wound yarn, and a drive means which is actuated based on signals detected by the sensor so as to move the bobbin holder in such a direction that it moves away from the contact roller, characterized in that the drive means is a means which is actuated by signals from the sensor detecting an amount of movement of the contact roller, and the winder is further provided with speed varying means for varying the speed of the drive means and control means for stepwise or continuously increasing the speed of the drive means.

According to the second aspect of the present invention, the above-described object is achieved by a yarn. winder comprising a bobbin holder for inserting a bobbin thereonto, a contact roller pressed onto the bobbin inserted onto the bobbin holder or a yarn layer wound on the bobbin, a traverse apparatus for traversing a yarn along the bobbin, a sensor for detecting a movement of the contact roller due to increase of the wound yarn, and a drive means which is actuated based on signals detected by the sensor so as to move the bobbin holder in such a direction that it moves away from the contact roller, characterized in that the winder further includes time limit means which is actuated by signals from the sensor detecting an amount of movement of the contact roller, speed varying means for varying the speed of the drive means, and control means for stepwise or continuously increasing the speed of the drive means at every predetermined time elapsed by the time limit means.

According to the third aspect of the present invention, the above-described object is achieved by a yarn winder comprising a bobbin holder for inserting a bobbin thereonto, a contact roller pressed onto the bobbin inserted onto the bobbin holder or a yarn layer wound on the bobbin, a traverse apparatus for traversing a yarn along the bobbin, a sensor for detecting a displacement of the contact roller due to increase of the wound yarn, and a drive means which is actuated based on an amount of the displacement detected by the sensor so as to move the bobbin holder in such a direction that it moves away from the contact roller, characterized in that the winder includes the sensor for detecting the displacement of the contact roller, speed varying means for varying the speed of the drive means based on the amount of displacement detected by the sensor, and control means for stepwise or continuously increasing the speed of the drive means based on the amount of the displacement of the contact roller due to increase of the yarn wound on the bobbin.

BRIEF DESCRIPTION OF THE DRAWINGS

The present invention will now be explained in detail with reference to the accompanying drawings, wherein:

FIGS. 3(*b*), (*c*) and (*d*) are time tables of other embodiments of the invention, respectively;

PREFERRED EMBODIMENT

Figure 1:
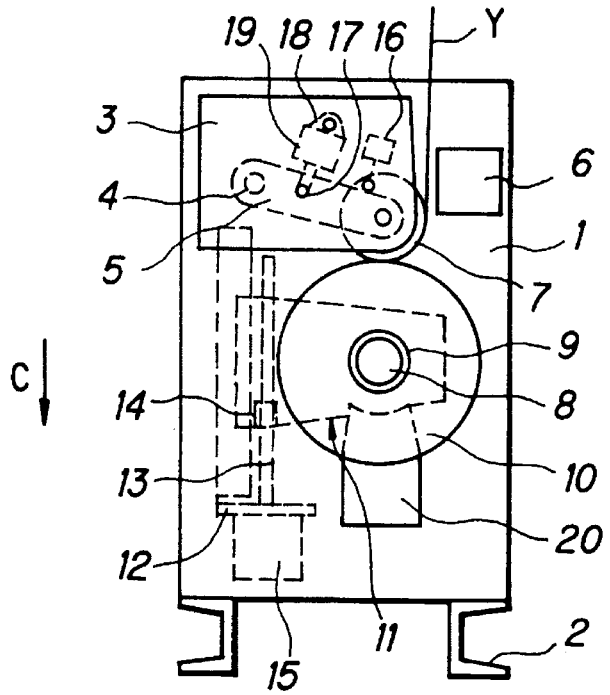
FIG. 1 is an elevation view of an embodiment of a winder to which the present invention is applied.

The construction of the present invention will now be explained with reference to FIG. 1 which is an elevation view of one embodiment of a winder of the present invention and FIG. 2 which is a flow chart of a control means according to the present invention.

A machine frame 1 is disposed on bases 2 which comprise a pair of channels. The machine frame 1 has a supporter 3 projecting therefrom. The supporter 3 has an arm 5 mounted on a pivot pin 4 swingably in a vertical direction. The arm 5 has a contact roller 7 rotatably mounted at an end thereof. The machine frame 1 has a traversing apparatus 6 projecting therefrom in such a manner that it faces and is in parallel with the contact roller 7. The traversing apparatus 6 traverses a yarn in a direction perpendicular to the sheet on which FIG. 1 is illustrated.

The machine frame 1 has a slider 11 mounted so as to be movable in a vertical direction, and the slider 11 rotatably supports a bobbin holder 8. The bobbin holder 8 is driven by an electric motor (not shown), and a bobbin 9, made of paper, is inserted onto the bobbin holder 8 in FIG. 1 so that package 10 is wound on the bobbin 9. The rotation of the electric motor (not shown) for driving the bobbin holder 8 is controlled by a controller (not shown) in accordance with a well known manner so that the number of rotations of the contact roller 7 coincides with a predetermined value during a winding operation.

Further, an end of a pneumatic cylinder 19 is pivoted to the arm 5 by means of a pin 17 while the other end of the pneumatic cylinder 19 is pivoted to the supporter 3 by means of a pin 18, and a predetermined amount of compressed air is supplied to the pneumatic cylinder 19 so that the weight of the arm 5 and the contact roller 7 is supported by the pneumatic cylinder 19 while a predetermined contact pressure is exerted between the contact roller 7 and the bobbin holder 8.

A sensor 16 is disposed at a position near the arm 5. When the contact roller 7 is moved upwardly a small distance due to increase of the wound package 10 during the yarn winding operation, the small distance is detected by the sensor 16 which is formed in a limit switch type, and the slider 11 which is supporting the winding bobbin holder 8 is moved downwardly, i.e., in a direction wherein the bobbin holder 8 moves away from the contact roller 7, a predetermined distance. More specifically, the slider 11 has a nut 14 secured thereto, and the nut 14 engages with a bolt 13 secured to a bracket 12, so that slider 11 is moved in a direction designated by an arrow C by means of a stepping motor 15.

As described above, the yarn package 10 is formed on the bobbin 9 inserted onto the bobbin holder 8, and when the contact roller 7 pressed to the package 10 is moved upwardly a small distance, the sensor 16 is switched on, and the stepping motor 15 is started, and when the bobbin holder 8 is moved downwardly, the sensor 16 is switched off, and the stepping motor 15 is stopped. The above-described operation is repeated as the wound package 10 increases until the package 10 reaches the predetermined amount.

When the package 10 reaches the predetermined amount, the stepping motor 15 is started so as to lower the slider 11 downwardly, and the bobbin holder 8 is released from the contact roller 7 and then is transferred to the doffing position and is maintained there.

Then, the plate 20 engaging with the bobbin, on which the yarn package 10 is formed, is pushed along the bobbin holder 8 by means of a pneumatic cylinder (not shown) so as to push out the package 10. More specifically, when the rotation of the package 10 is stopped by means of a braking device (not shown), the package 10 is pushed out from the bobbin holder 8 by means of the plate 20.

Thereafter, an empty bobbin 9 is inserted onto the bobbin holder. Then, the foregoing operation is repeated for winding a new yarn package.

In the present embodiment, a yarn winder is constructed which winder comprises a bobbin holder for inserting a bobbin thereonto, a contact roller pressed onto the bobbin inserted onto the bobbin holder or a yarn layer wound on the bobbin, a traverse apparatus for traversing a yarn along the bobbin, a sensor for detecting a movement of the contact roller due to increase of the wound yarn, and a drive means which is actuated based on signals detected by the sensor so as to move the bobbin holder in such a direction that it moves away from the contact roller, characterized in that the winder further includes time limit means which is actuated by signals from the sensor detecting an amount of movement of the contact roller, speed varying means for varying an amount of the speed of the drive means, and control means for stepwise or continuously increasing the speed of the drive means at every predetermined time elapsed by the time limit means. The present invention relates to control of the speed of the bobbin holder with respect to increase of the wound layer.

Now, the operation of the control means of the present invention will now be explained in detail with reference to FIG. 2.

Figure 2:
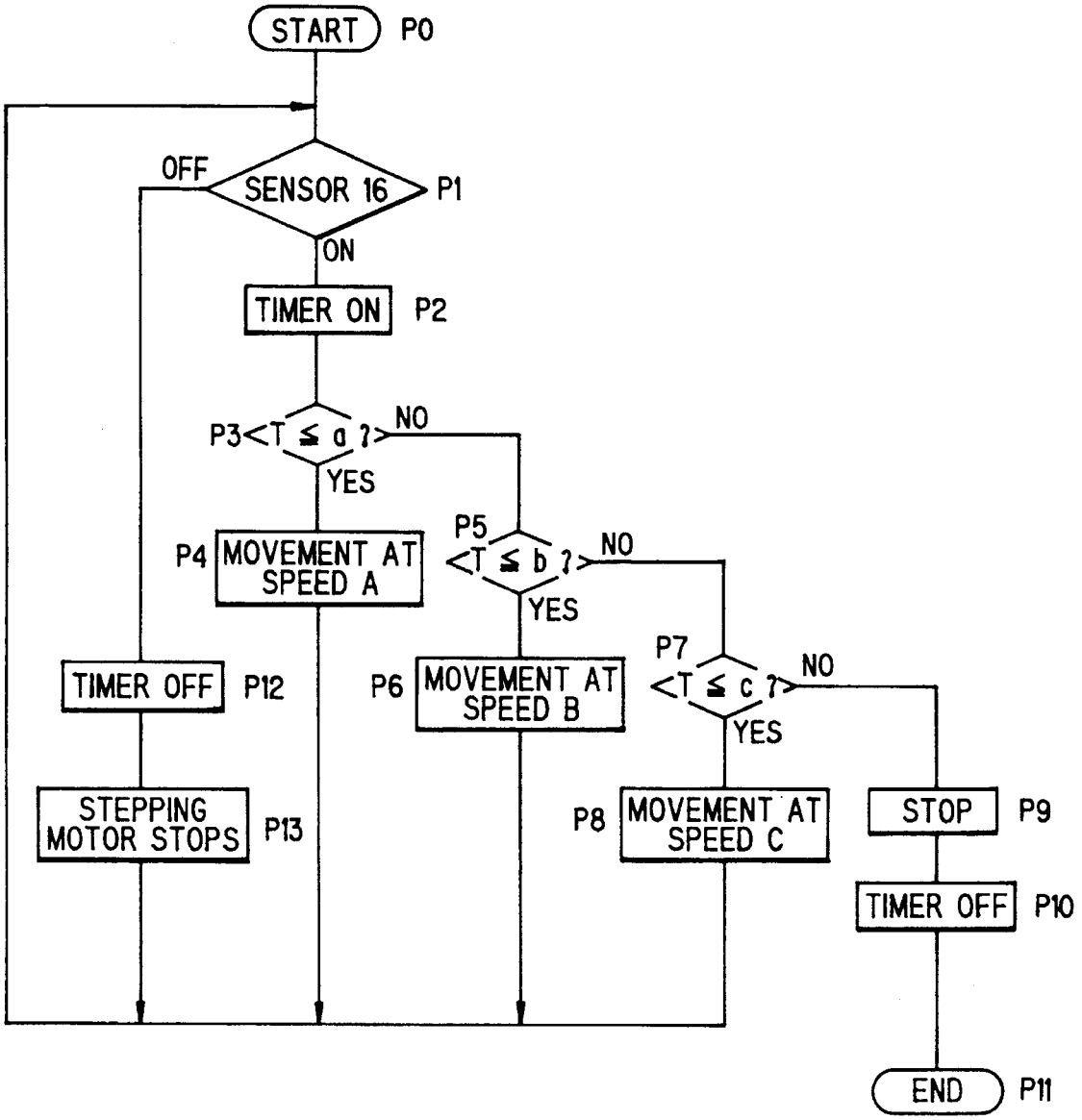
FIG. 2 is a flow chart of a control means according to one embodiment of the present invention.
Figure 3A:
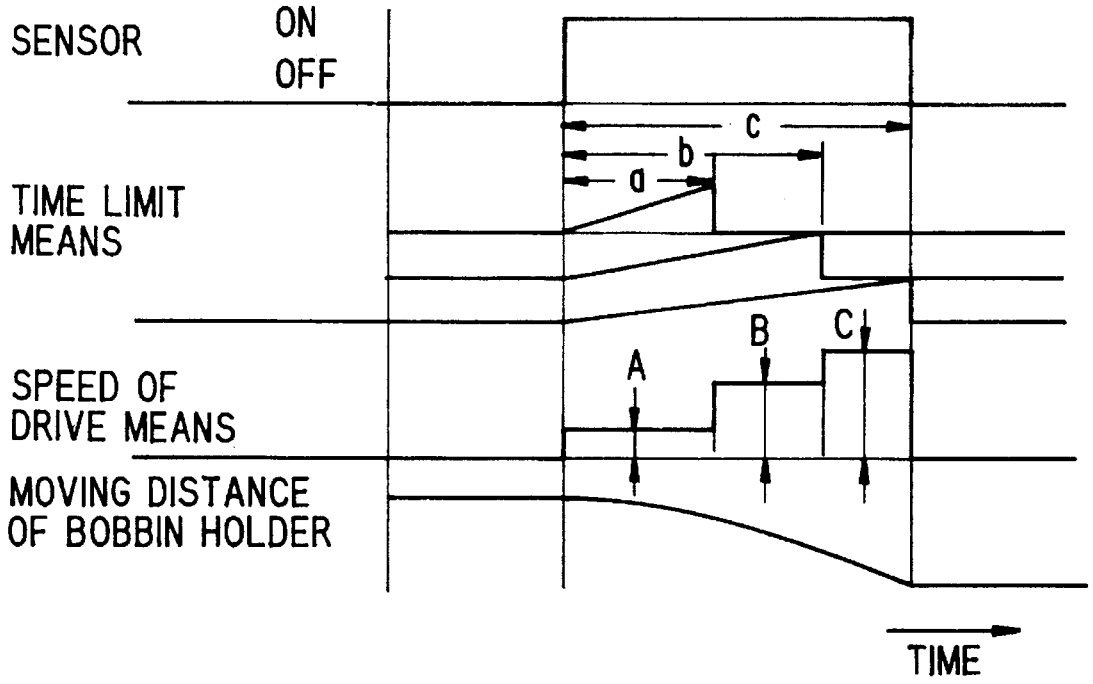
FIG. 3(*a*) is a the table of the embodiment illustrated in FIG. 2.
Figure 3B:
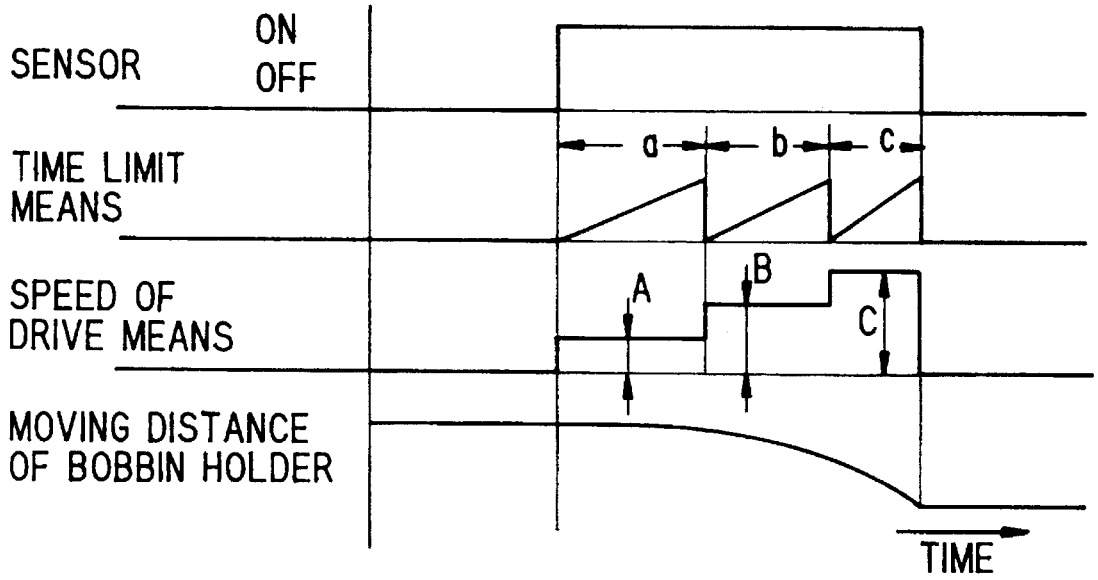
Figure 3C:
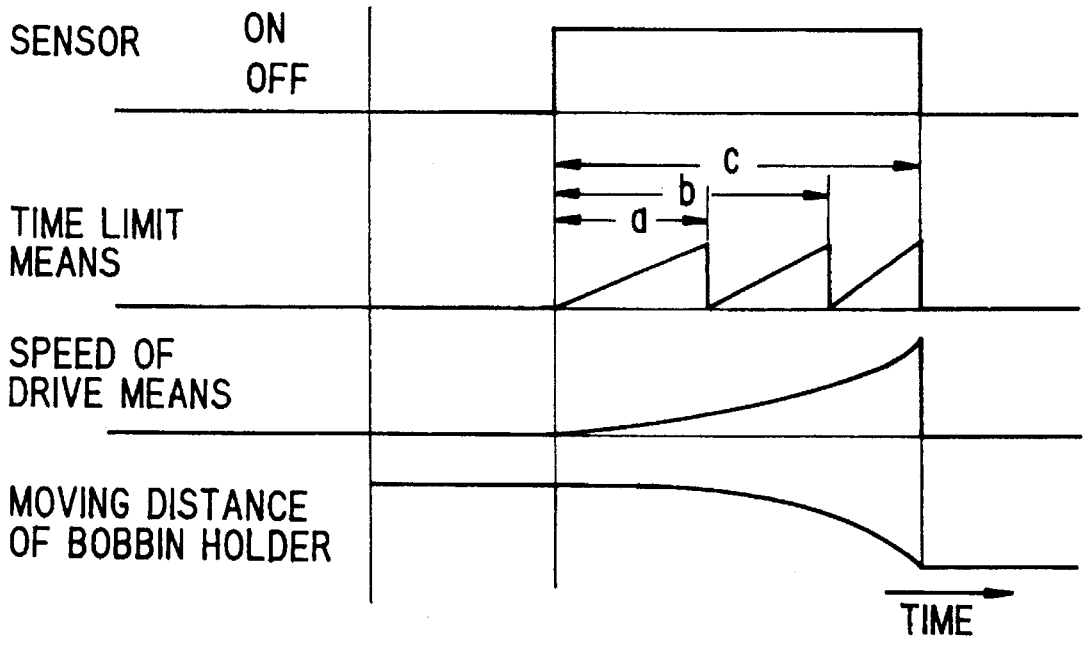
Figure 3D:
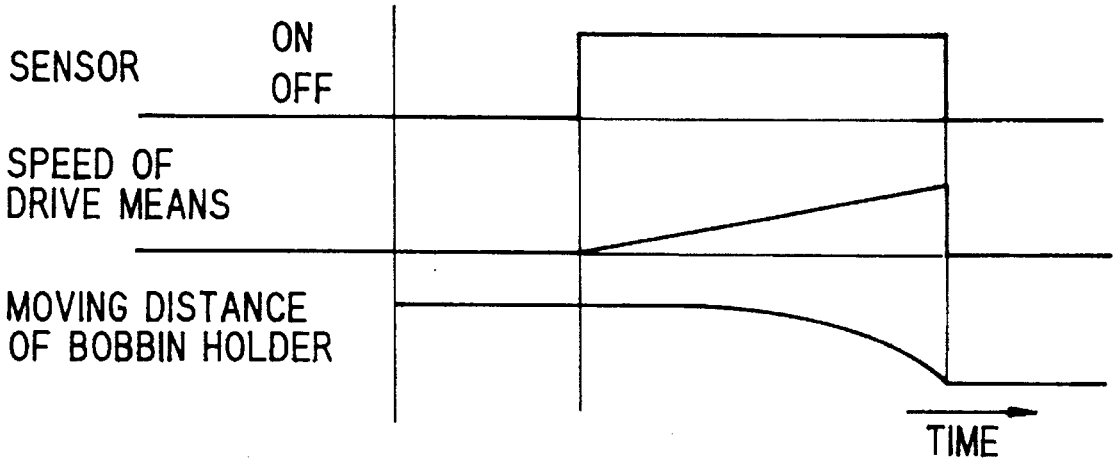

In FIG. 2, when the winding of a yarn is started, the program starts (at step $P_0$), and it proceeds to step $P_1$. At step $P_1$, if the sensor 16 is switched off, then step $P_{13}$ takes place through step $P_{12}$, and then step $P_1$ again takes place.

Contrary to this, if the sensor 16 is switched on at step $P_1$, step $P_2$ takes place where the timer is activated. Then, if the time elapsed T is smaller than a predetermined time a, the stepping motor 15 is started so as to lower the bobbin holder 8, i.e., to move the bobbin holder 8 away from the contact roller 7, at a predetermined speed A, and then the step $P_1$ takes place again.

At step $P_1$, if the sensor 16 is still being switched on, step $P_2$ takes place, and further step $P_3$ takes place. At step $P_3$, if the time elapsed T is larger than the predetermined time a, step $P_5$ takes place. At step $P_5$, if the time elapsed T is smaller than the predetermined time b, the stepping motor 15 is moved at a predetermined speed B, and then the step $P_1$ takes place again.

If the sensor 16 is being switched off at step $P_1$, then step $P_{12}$ takes place where the timer is turned off, and then at step $P_{13}$, the stepping motor 15 is stopped and the winding operation is continued until the sensor 16 is switched on again.

When the time elapsed T exceeds the predetermined time b at the above-described step $P_5$, step $P_7$ takes place. At step $P_7$, if the time elapsed T is smaller than the predetermined time c, step $P_8$ takes place where the stepping motor 15 is moved at a predetermined speed C, and then the step $P_1$ takes place again. If the time elapsed T exceeds the predetermined time c at step $P_7$, i.e., if the winding condition exceeds the maximum specification of the winder, step $P_9$ takes place where the winder is stopped, and at step $P_{10}$, the timer is turned off, and step $P_{11}$ takes place.

The above-described predetermined speeds A, B and C indicate the rotating speeds of the stepping motor 15, in other words, the speed of the bobbin holder 8 moving away from the contact roller 7, and they are set in such a condition as $A<B<C$.

In the above-described embodiment, the predetermined time b, which includes the predetermined time a, and the predetermined time c, which includes the predetermined time a, are accumulated timer operating times, i.e., times wherein the timers are switched on. However, the predetermined times b and c may be individual timer operating times, which do not include the predetermined time a nor b, respectively, as illustrated in FIG. 3(*b*). Further, the number of the levels, which was three, i.e., A, B and C, in the above-described embodiment, is not limited. In addition, although the speed was changed stepwise in the above-described embodiment, the speed may be changed continuously as illustrated in FIG. 3(*c*).

Figure 4:
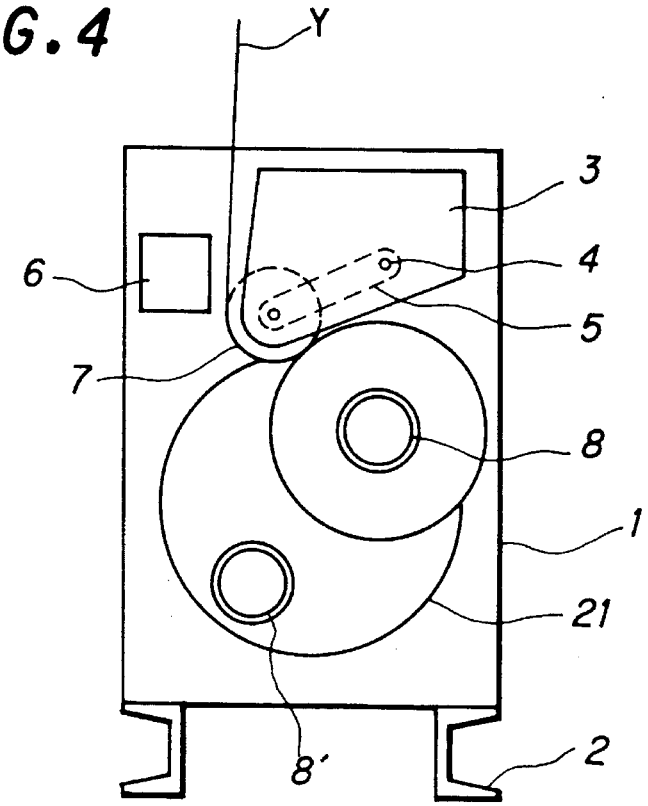
FIG. 4 is an elevation view of another embodiment of a winder to which the present invention is applied.

Although a manual winder which has a single bobbin holder is exemplified in the above-described embodiment, the present invention may be carried out in an automatic bobbin changing winder as illustrated in FIG. 4 which has a turnable turret table 21, which has two bobbin holders 8 and 8' rotatably supported thereon. In this embodiment, the amount of the displacement of the contact roller 7 is detected in a manner similar to that of the embodiment illustrated in FIG. 1, and the turret table 21 is turned in such a direction that the bobbin holder 8 onto which the yarn is being wound is moved away from the contact roller 7, and the turning speed of the turret table 21 is varied in accordance with the flow chart of the present invention.

Figure 5:
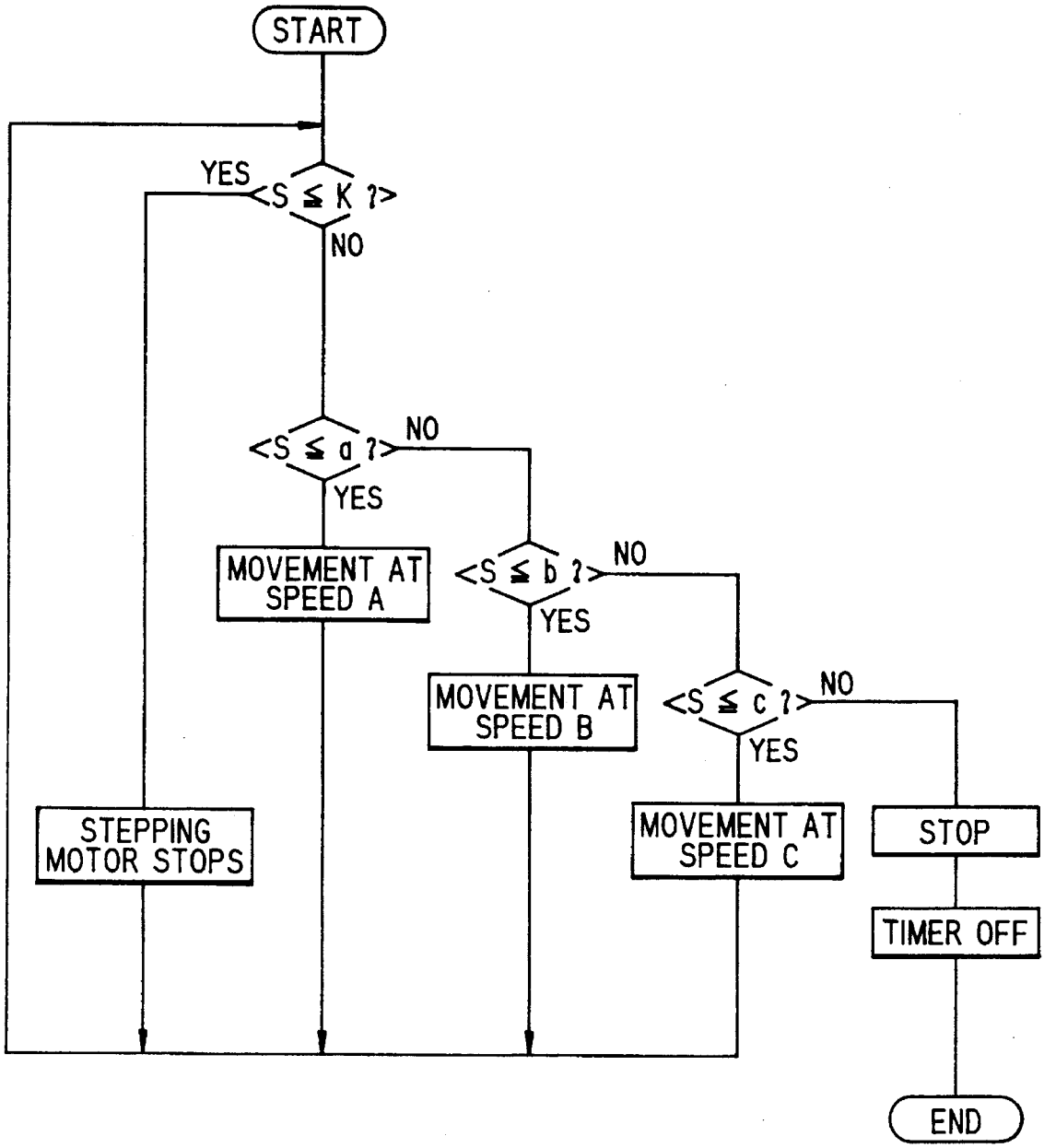
FIG. 5 is a flow chart of a control means according to another embodiment of the present invention.
Figure 6:
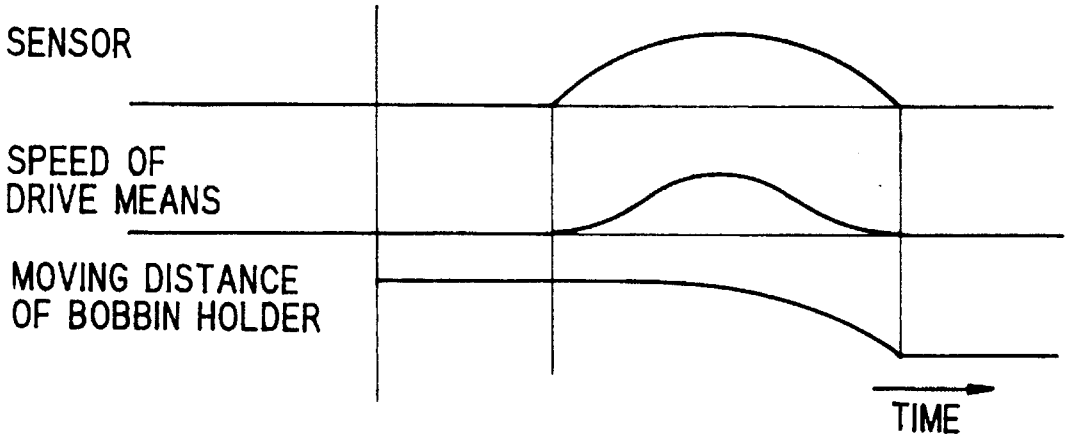
FIG. 6 is a time table of the embodiment illustrated in FIG. 5.

In the embodiment illustrated in FIGS. 1 and 2, the moving speed is varied in accordance with the on and off signals of the sensor 16 and the times elapsed. However, according to the present invention, a displacement sensor for detecting the amount of displacement may be used in place of the sensor 16 of a limit switch type disclosed with respect to the above-described embodiment, and the moving speed may be varied in accordance with the amount of the displacement S of the contact roller 7. An example of an operational flow chart of the control means wherein such a displacement sensor is used is illustrated in FIG. 5, and its time table is illustrated in FIG. 6.

The present invention may be a yarn winder which comprises a bobbin holder for inserting a bobbin thereonto, a contact roller pressed onto the bobbin inserted onto the bobbin holder or a yarn layer wound on the bobbin, a traverse apparatus for traversing a yarn along the bobbin, a sensor for detecting a movement of the contact roller due to increase of the wound yarn, and a drive means which is actuated based on signals detected by the sensor so as to move the bobbin holder in such a direction that it moves away from the contact roller, characterized in that the winder further includes time limit means which is actuated by signals from the sensor detecting an amount of movement of the contact roller, speed varying means for varying the speed of the drive means, and control means for stepwise or continuously increasing the speed of the drive means at every predetermined time elapsed by the time limit means. An example of a time table of the control means of this type is illustrated in FIG. 3(*d*).

Although the moving distance of the contact roller is detected by a displacement sensor in this embodiment, the small moving distance of the contact roller may be detected by a pressure sensitive sensor as a change of pressure, and accordingly change of force.

The winder of the present invention may include two bobbin holders, and the contact roller may be pressed to the bobbin inserted onto one of the bobbin holders and the yarn may be traversed along the bobbin so as to be wound on the bobbin, and when the amount of yarn wound on the bobbin inserted onto one of the bobbin holders reaches a predetermined value, the winding of the yarn may be changed to another bobbin inserted onto the other one of the bobbin holders, the winder may be characterized in that the winder includes a first slider guide means which guide the bobbin holder from winding position to a doffing position, a second slider guide means which guide the bobbin holder from the doffing position to a stand-by position near the winding position, sliders slidable along the first and second slider guide means, and carriers which carry the bobbin holder and which can be transfered between the sliders of the first and second slider guide means. An embodiment of this type is illustrated in FIG. 7, and the difference from the embodiment illustrated in FIG. 1 will now be briefly explained.

The machine frame 1 has an opening 1*a* substantially formed in a triangular shape at a position below the supporter 3, and a first slider guide means 30 is stationary and secured inside the machine frame at a position near the substantially vertical right side of the opening 1*a*.

Further, the machine frame 1 has a shaft 38 extending in an axial direction of the bobbin holders 8 and 8' at a lower left position of the opening 1*a*. A second slider guide means 37 is swingably supported by the shaft 38 and is pivotably connected to a pneumatic cylinder 39. Thus, the second slider guide means 37 can be swung by means of the pneumatic cylinder 39 about the shaft 38 indicated by an arrow A in FIG. 7.

Figure 7:
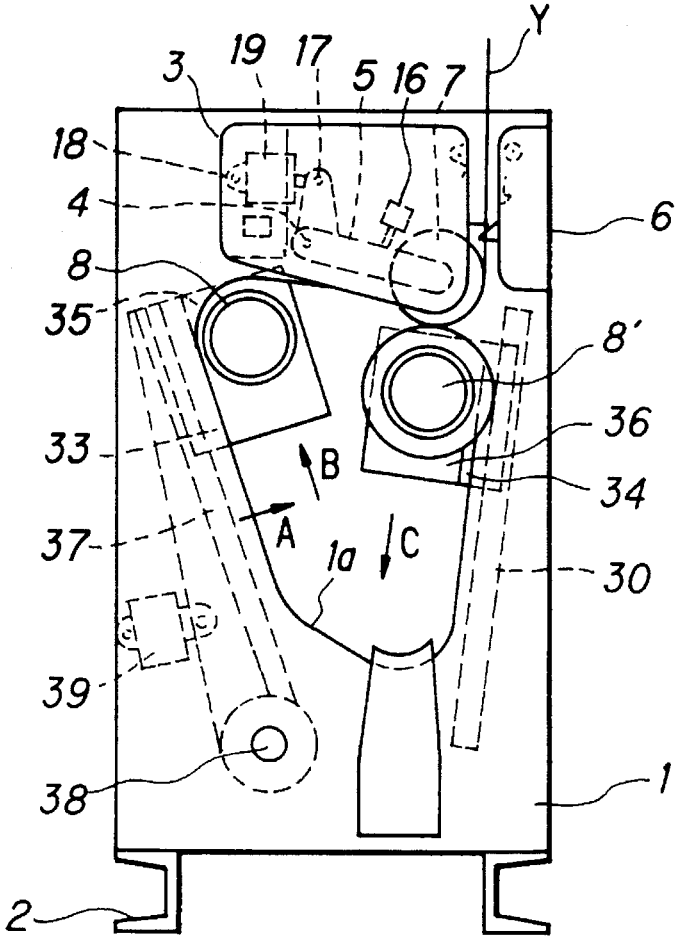
FIG. 7 is an elevation view of still another embodiment of a winder to which the present invention is applied.

In addition, a slider 33 is vertically slidable along the second slider guide means 37 as indicated by an arrow B in FIG. 7, while a slider 34 is vertically slidable along the first slider guide means 30 as indicated by arrow C in FIG. 7.

Carriers 35 and 36 rotatably support the bobbin holders 8 and 8', respectively, and the bobbin holder 8 and 8' are connected to drive motors (not shown), respectively, which are integrally fixed to the carriers 35 and 36, respectively.

When the carrier 35 or 36 is connected to the slider 34, the carrier 35 or 36 can be moved from a winding position, where the bobbin inserted onto the bobbin holder 8 or 8' is in contact with the contact roller 7, to a doffing position by means of downward movement of the slider 34 along the first slider guide means 30.

When the carrier 35 or 36 is connected to the slider 33, the carrier 35 or 36 can be moved from the above-described doffing to a stand-by position, and further from the stand-by position to the winding position by means of the swing motion of the second slider guide means 37 about the shaft 38 and the sliding movement of the slider 33 along the second slider guide means 37.

According to the present invention, since the moving speed of a bobbin holder can be automatically set so as to be suitable for increasing a yarn package wound onto the winder bobbin holder, operability is very good, and the winding can be used for winding various kinds of yarn. Further, since the moving speed can be varied in accordance with the thickness of the wound yarn, a yarn package can be formed in a good shape without causing yarn droops at ends of the package even when a thin yarn, which has often suffered from such yarn drops, is wound.

What is claimed is:

1. A yarn winder composing:

a bobbin holder for supporting a bobbin thereon, the bobbin having an outer surface adapted to receive yarn wound thereabout;

a contact roller capable of being pressed against the outer surface of the bobbin inserted onto said bobbin holder, wherein the contact roller presses against a yarn layer as yarn is wound on the outer surface of the bobbin;

a transverse apparatus for traversing a yarn along the bobbin;

a sensor for detecting and generating a signal in response to a predetermined amount of movement of the contact roller due to an increase of the yarn wound on the bobbin;

supporting means for supporting the bobbin holder; and drive means coupled to the supporting means for moving said bobbin holder in a direction away from said contact roller, said drive means including time limit means actuated in response to said signal from said sensor for measuring the time said sensor has generated said signal, and speed varying means for increasing the speed a which said drive means moves said bobbin holder away from said contact roller in response to the amount of time measured by said time limit means.

2. A yarn winder according to claim 1, wherein two bobbin holders are provided, and said supporting means s a rotary table on which the two bobbin holders are rotatable mounted so as to project outward from the rotary table, wherein yarn is wound onto which the yarn so being wound is moved away from the contact roller by moving the rotary table.

3. A yarn winder according to claim 1, wherein two bobbin holders are provided and project from a machine frame, and including means for individually moving the two bobbin holders, respectively, based on increase of wound yarn.

4. A winder according to any claim 1, wherein two bobbin holders are provided, and the contact roller is pressed against a bobbin inserted onto one of the two bobbin holders and the yarn is traversed along the bobbin on the one bobbin holder so as to be wound on the bobbin until the amount of yarn wound on the bobbin inserted onto the one bobbin holder reaches a predetermined value, and further comprising:

a first slider guide which guides the one bobbin holder from a winding position to a doffing position, and a second slider guide which guides the one bobbin holder from the doffing position to a stand-by position adjacent the winding position;

first and second sliders slidably disposed on the first and second slider guides; and first and second carriers removably attached to the first and second sliders which respectively carry the two bobbin holders, wherein at least one of the slider guides is movable such that the carriers are transferrable from one slider to the other slider.

* * * * *

UNITED STATES PATENT AND TRADEMARK OFFICE

CERTIFICATE OF CORRECTION

PATENT NO. : 5,558,286

DATED : September 24, 1996

INVENTOR(S) : Takami Sugioka et al.

It is certified that error appears in the above-indentified patent and that said Letters Patent is hereby corrected as shown below:

In the Claims: Col. 6, line 60 (claim 1), "composing" should be -- comprising --.

Signed and Sealed this

Seventh Day of January, 1997

*Attest:*

*Attesting Officer*

BRUCE LEHMAN

*Commissioner of Patents and Trademarks*